US011808434B2

(12) United States Patent
Cai

(10) Patent No.: US 11,808,434 B2
(45) Date of Patent: Nov. 7, 2023

(54) LIGHTING FIXTURE CONVENIENT TO PACK

(71) Applicant: Yueqi Cai, Ningbo (CN)

(72) Inventor: Yueqi Cai, Ningbo (CN)

( * ) Notice: Subject to any disclaimer, the term of this patent is extended or adjusted under 35 U.S.C. 154(b) by 0 days.

(21) Appl. No.: 17/844,084

(22) Filed: Jun. 20, 2022

(65) Prior Publication Data

US 2022/0316681 A1 Oct. 6, 2022

Related U.S. Application Data

(63) Continuation-in-part of application No. 17/722,415, filed on Apr. 18, 2022, now abandoned.

(51) Int. Cl.
*F21V 1/14* (2006.01)
*F21V 23/06* (2006.01)

(52) U.S. Cl.
CPC ..... *F21V 1/14* (2013.01); *F21V 23/06* (2013.01)

(58) Field of Classification Search
CPC ..... F21V 1/14; F21V 23/06; F21V 17/007; F21V 23/008; F21Y 2115/10
See application file for complete search history.

(56) References Cited

U.S. PATENT DOCUMENTS

2008/0130274 A1* 6/2008 Fails ..... F21V 23/0435 362/157
2008/0170384 A1* 7/2008 Zhu ..... F21V 1/14 362/257
2009/0014348 A1* 1/2009 Strange ..... B65D 21/0223 206/508
2019/0319462 A1* 10/2019 Hsu ..... F21V 23/02
2019/0339439 A1 11/2019 Hawthorne et al.
2020/0063954 A9 2/2020 Shi
2020/0355359 A1 11/2020 Pan et al.

* cited by examiner

*Primary Examiner* — Evan P Dzierzynski

(57) ABSTRACT

The present invention discloses a lighting fixture convenient to pack, which consists of a lampshade, wherein the lampshade consists of a hood body with an inner cavity and a frame at the opening edge of the inner cavity; the frame is away from the inner cavity; the inner cavity is used to accommodate the luminous source of the lighting fixture; the hood body consists of a horizontal outer wall surface and multiple oblique outer wall surfaces formed at the edge of the horizontal outer wall surface; and the inner cavity consists of a horizontal inner wall surface and multiple oblique inner wall surfaces formed at the edge of the horizontal inner wall surface.

7 Claims, 12 Drawing Sheets

LIGHTING FIXTURE CONVENIENT TO PACK

TECHNICAL FIELD

The present invention relates to the field of the invention of a lighting fixture and lighting fixture packaging, particularly to a lighting fixture convenient to pack and a lighting fixture assembly method.

BACKGROUND

Lighting fixture is a necessary appliance mainly used for home lighting and public lighting. Generally, in order to improve the lighting effect and illumination area effect, the volume of the lighting fixture will be increased. In the prior art, during the packaging, a single lighting fixture is packaged by a box body (200). Therefore, when there are a large number of lighting fixtures, since each lighting fixture requires a box body (200), the packaging cost will be high. In addition, the volume of the lighting fixture after the packaging is rather large and the number of the lighting fixtures that can be transported by each vehicle for each transportation is limited, multiple vehicles will be required for each transportation, resulting in high transportation cost.

SUMMARY

The present invention is to design a lighting fixture convenient to pack and a lighting fixture assembly method, and the specific method is as follows.

The present invention relates to a lighting fixture convenient to pack, which is characterized in that it consists of a lampshade, wherein the lampshade consists of a hood body with an inner cavity and a frame at the opening edge of the inner cavity; the frame is away from the inner cavity; the inner cavity is used to accommodate the luminous source of the lighting fixture; the hood body consists of a horizontal outer wall surface and the first oblique outer wall surface, the second oblique outer wall surface, the third oblique outer wall surface, and the fourth oblique outer wall surface formed at the edge of the horizontal outer wall surface; the first oblique outer wall surface and the second oblique outer wall surface are arranged opposite to each other, while the third oblique outer wall surface and the fourth oblique outer wall surface are arranged opposite to each other; the first oblique outer wall surface/the second oblique outer wall surface/the third oblique outer wall surface/the fourth oblique outer wall surface formed at the edge of the horizontal outer wall surface and the horizontal outer wall surface has an included angle of a; the inner cavity consists of a horizontal inner wall surface and the first oblique inner wall surface, the second oblique inner wall surface, the third oblique inner wall surface, and the fourth oblique inner wall surface formed at the edge of the horizontal inner wall surface; the first oblique inner wall surface and the second oblique inner wall surface are arranged opposite to each other, while the third oblique inner wall surface and the fourth oblique inner wall surface are arranged opposite to each other; the first oblique inner wall surface/the second oblique inner wall surface/the third oblique inner wall surface/the fourth oblique inner wall surface and the horizontal inner wall surface has an included angle of b; the frame consists of the first edging, the second edging, and the third edging; the opening edge of the inner cavity is arranged with four edge connecting pieces that are connected end to end; the first edging, the second edging, and the third edging are respectively fixed on any three edge connecting pieces; two ends of the first edging are respectively connected with one end of the second edging and one end of the third edging; and the inner walls of the first edging, the second edging, and the third edging are arranged with the elongated slots for the insertion of light-transmitting plate sides of the lighting fixture.

Preferably, the frame also has the fourth edging, on which an actuator is fixed; two ends of the fourth edging are respectively connected with the other end of the second edging and the other end of the third edging in a removable manner, and the inner wall of the fourth edging is arranged with the elongated slots for the insertion of light-transmitting plate sides of the lighting fixture.

Preferably, the first connecting plug is inserted on the oblique outer wall surface of the hood body, the second connecting plug is arranged on the actuator, and the first connecting plug and the second connecting plug are connected.

Preferably, the fourth edging is connected to the remaining edge connecting piece.

Preferably, the frame also has the joints fixed on both ends of the fourth edging; each joint has an inserting part and a fastening part; the other end of the second edging and the other end of the third edging are respectively equipped with the inserting slots that match the inserting parts; each inserting slot has a fastening slot that matches the fastening part; the inserting part is inserted into the inserting slot, and the fastening part is fastened into the fastening slot.

Preferably, the included angle a is 237° and the included angle b is 123°.

Preferably, the lampshade consists of a hood body formed by the stamping of a metal plate and a frame at the opening edge of the inner cavity.

The present invention relates to a lighting fixture convenient to pack and a lighting fixture assembly method. The oblique inner wall surfaces, the oblique outer wall surfaces, and the frame away from the inner cavity are arranged to realize the stacking of multiple lampshades. In addition, after the stacking, for two adjacent lampshades, one lampshade is placed on the other lampshade, the hood body of one lampshade is placed in the inner cavity of the other lampshade, the frame of one lampshade fits the frame of the other lampshade, the multiple oblique outer wall surfaces of one lampshade have certain spacing with the multiple oblique inner wall surfaces of the other lampshade, and the horizontal outer wall surface of one lampshade has certain spacing with the horizontal inner wall surface of the other lampshade. The spacing is set to prevent the friction between the outer wall of the lampshade and the inner wall of the lampshade and avoid any scratches on the outer wall of the lampshade. In addition, multiple lampshades are stacked for the packaging of multiple lighting fixtures each time, thus reducing the packaging cost and transportation cost.

DETAILED DESCRIPTION

Technical solutions in embodiments of the present invention will be clearly and completely described with reference to the drawings in the embodiments of the present invention. Apparently, the embodiments described below are merely part, not all, of the embodiments of the present invention. Based on the embodiments described in the present invention, all other embodiments obtained by those of ordinary skill in the art are within the scope of the present invention.

Embodiment

Figure 1:
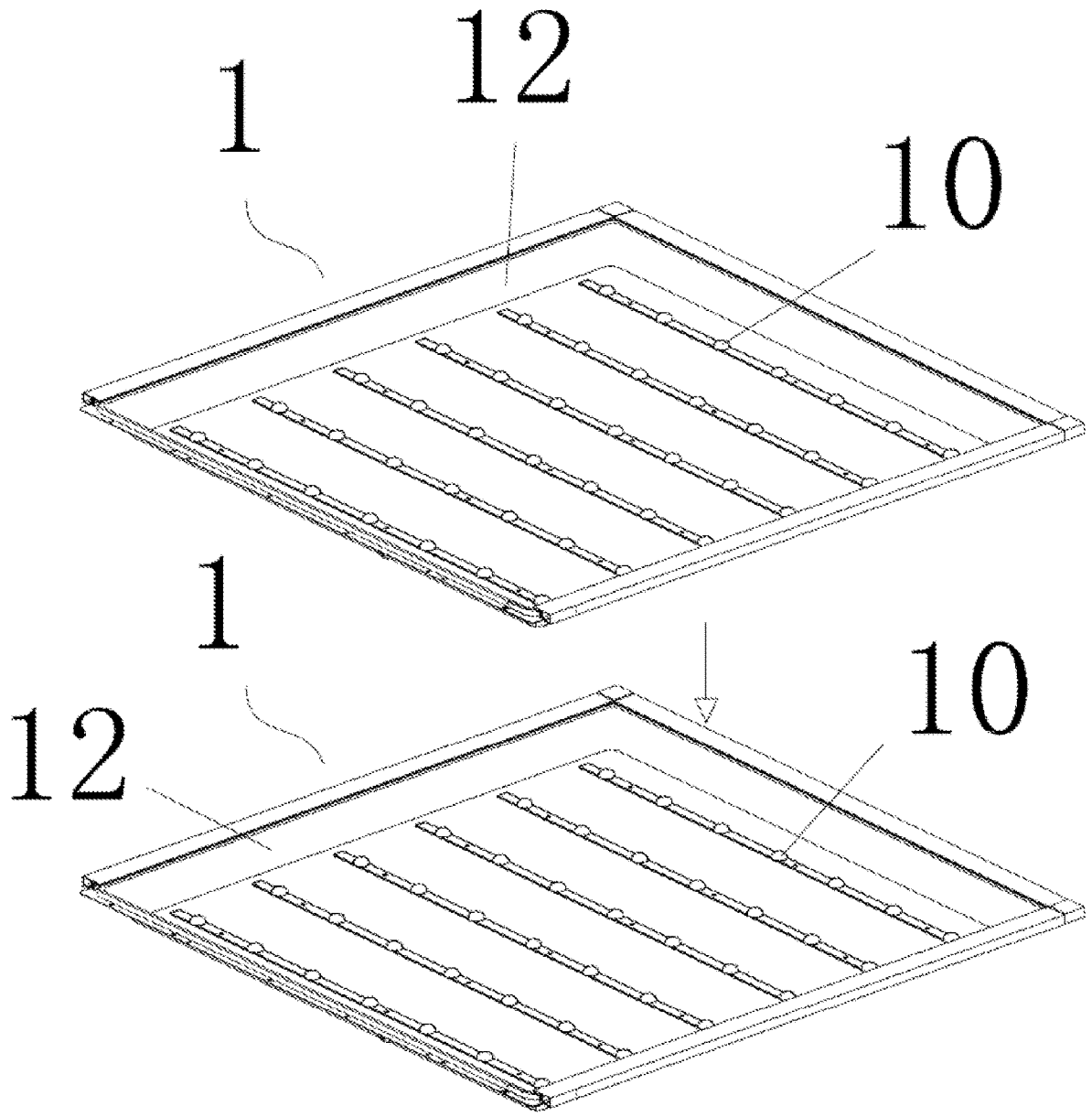
FIG. 1 is an exploded view of two lampshades.
Figure 2:
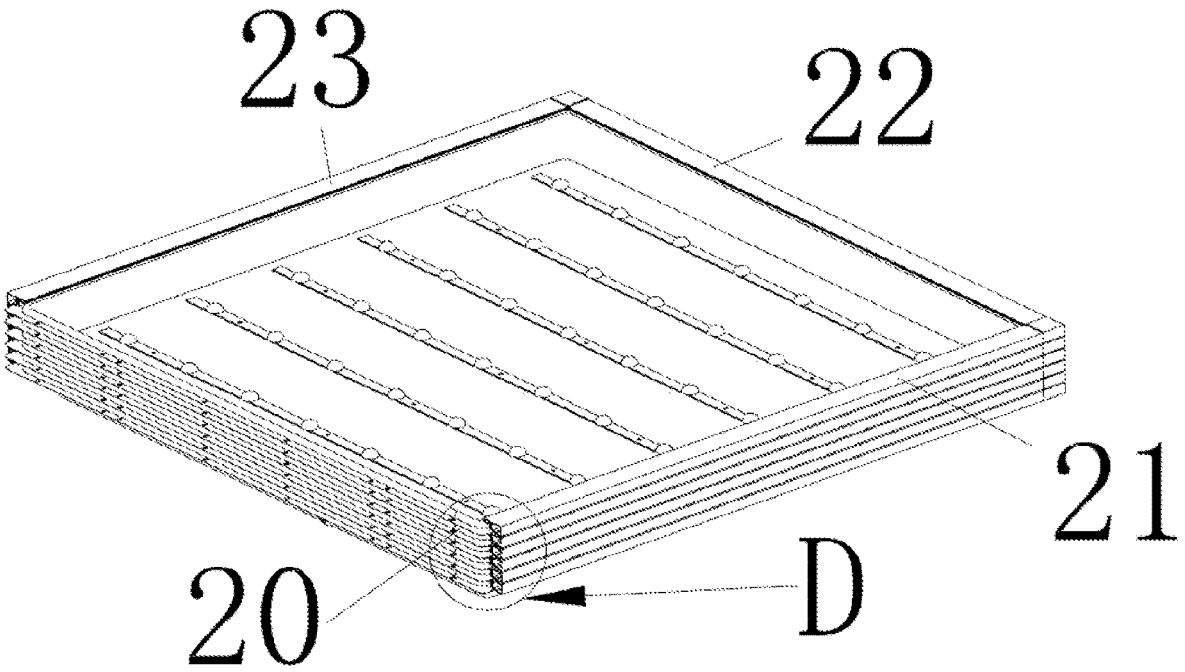
FIG. 2 is a structural schematic view (I) of six stacked lampshades.
Figure 3:
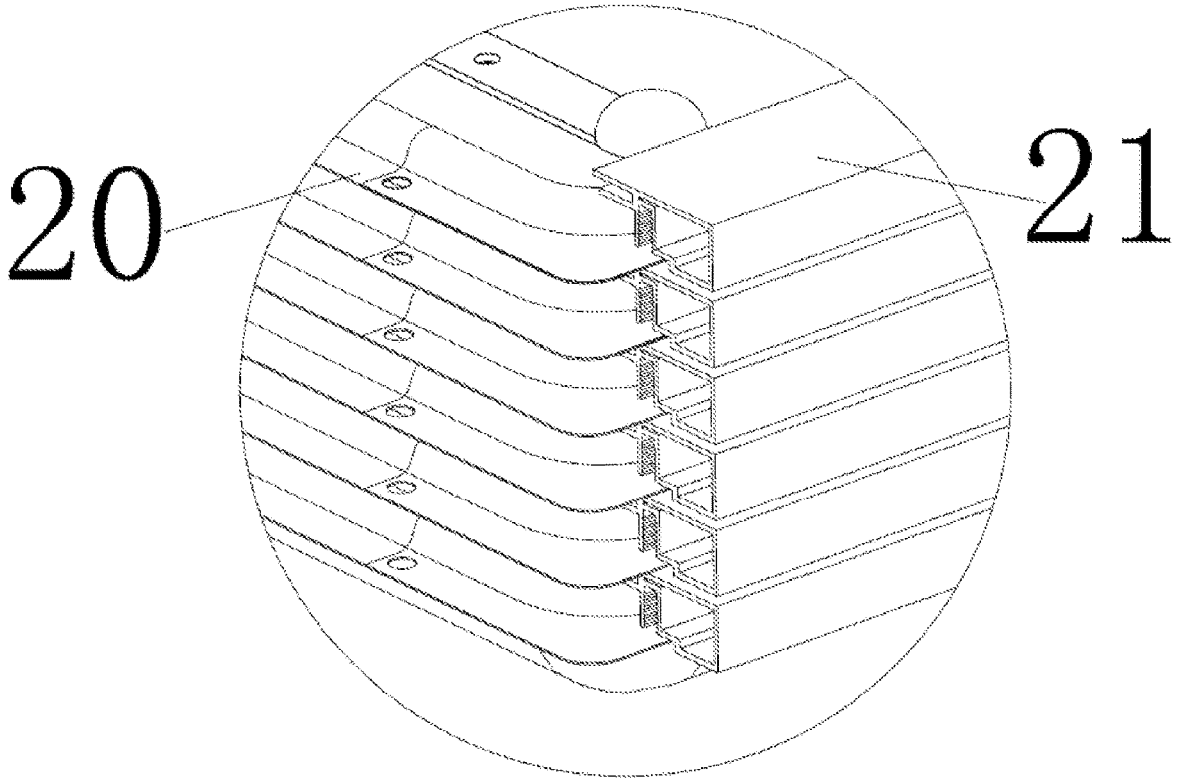
FIG. 3 is an enlarged view of Position D.
Figure 4:
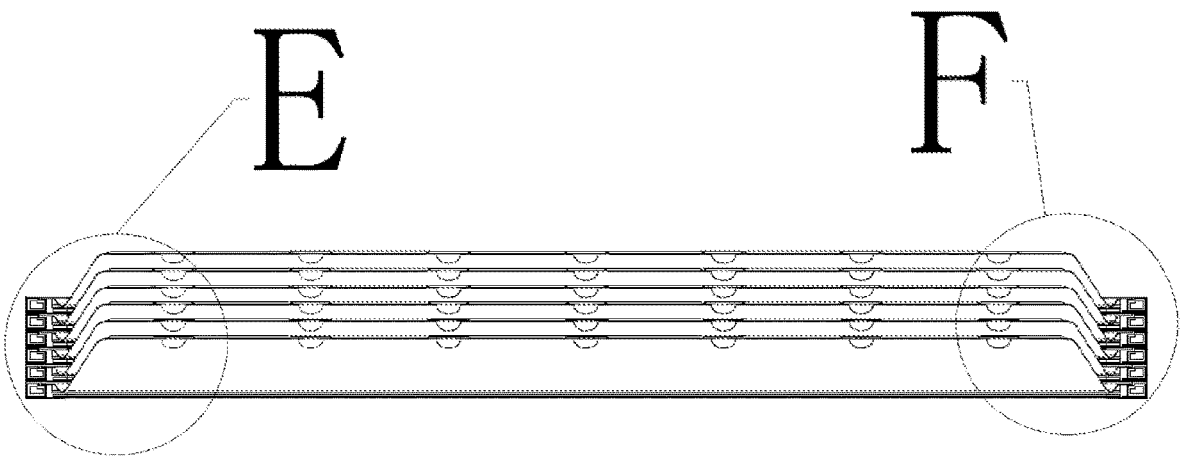
FIG. 4 is a structural schematic view (II) of six stacked lampshades.
Figure 5:
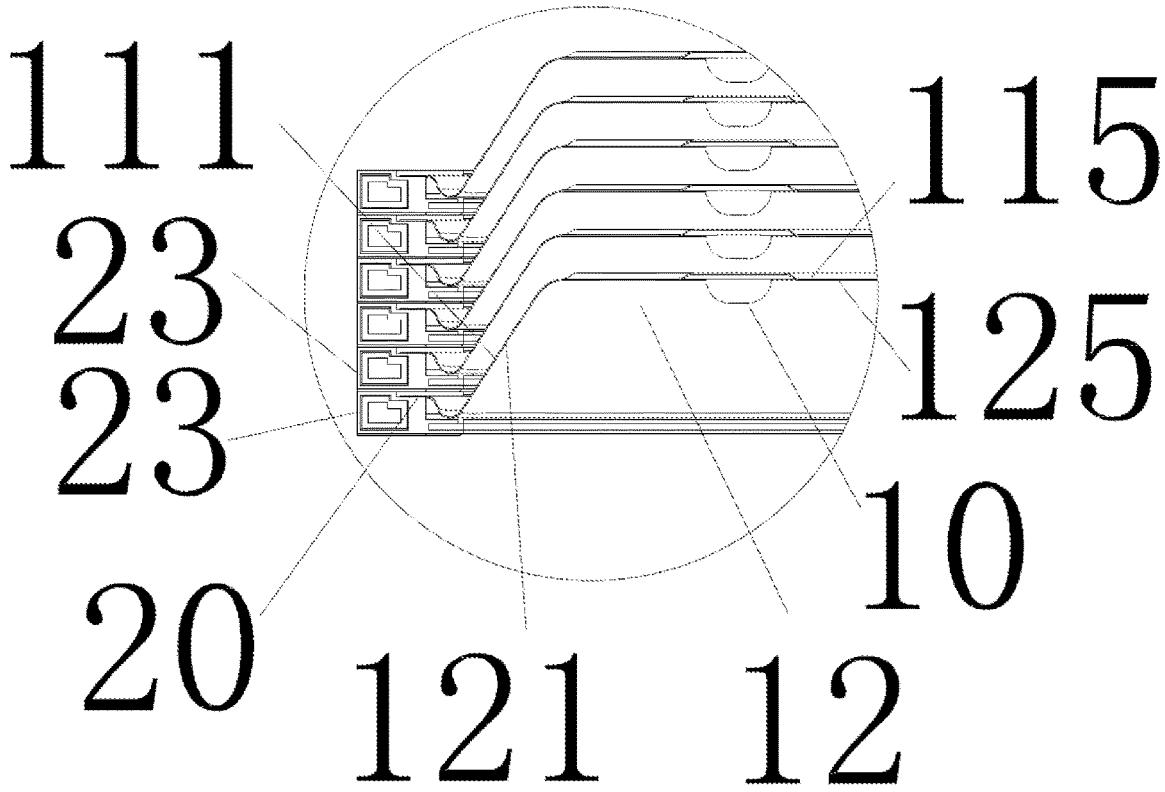
FIG. 5 is an enlarged view of Position E.
Figure 6:
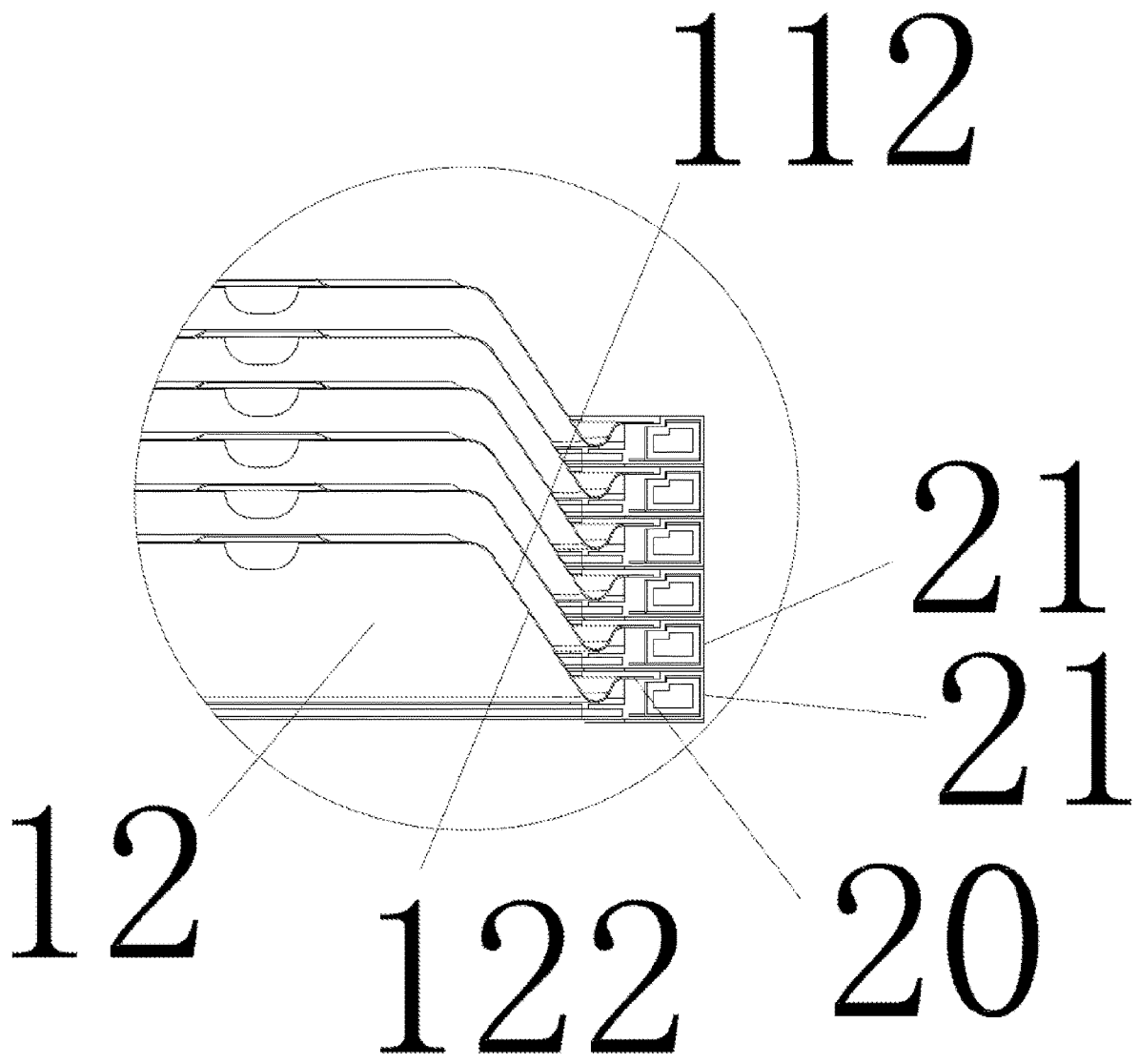
FIG. 6 is an enlarged view of Position F.
Figure 7:
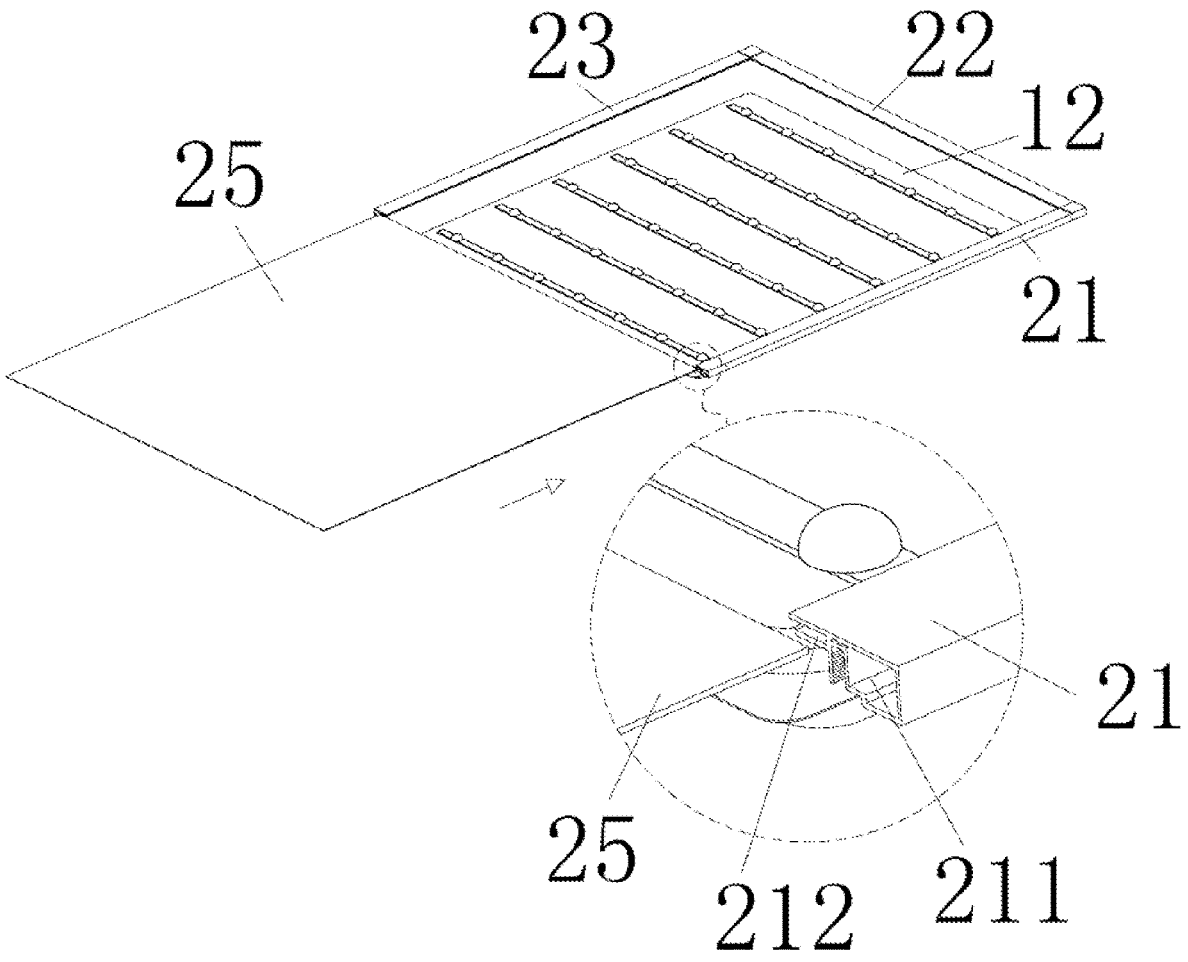
FIG. 7 is the structural schematic view (I) of the assembly of lighting fixtures.
Figure 8:
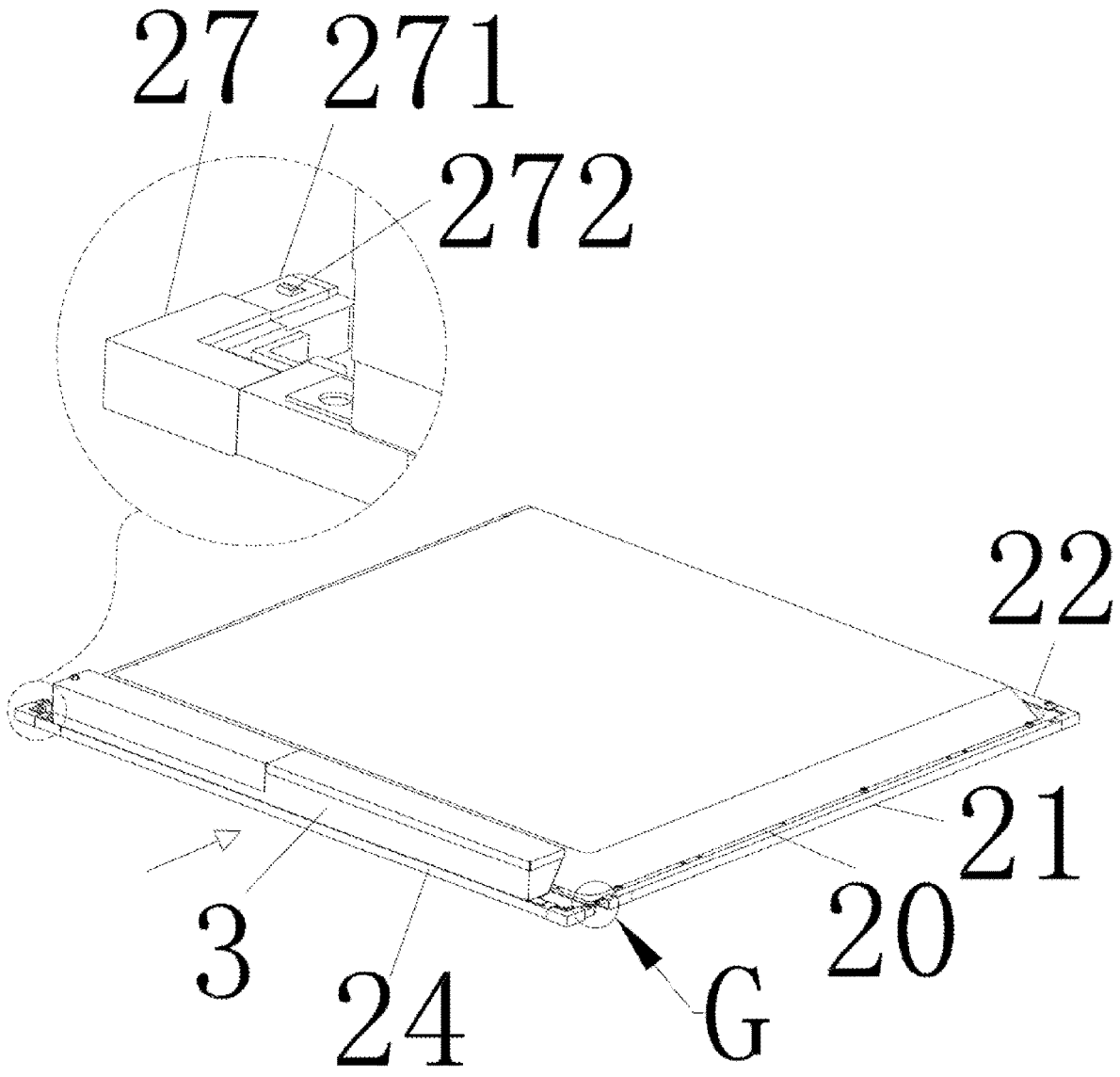
FIG. 8 is the structural schematic view (II) of the assembly of lighting fixtures.
Figure 9:
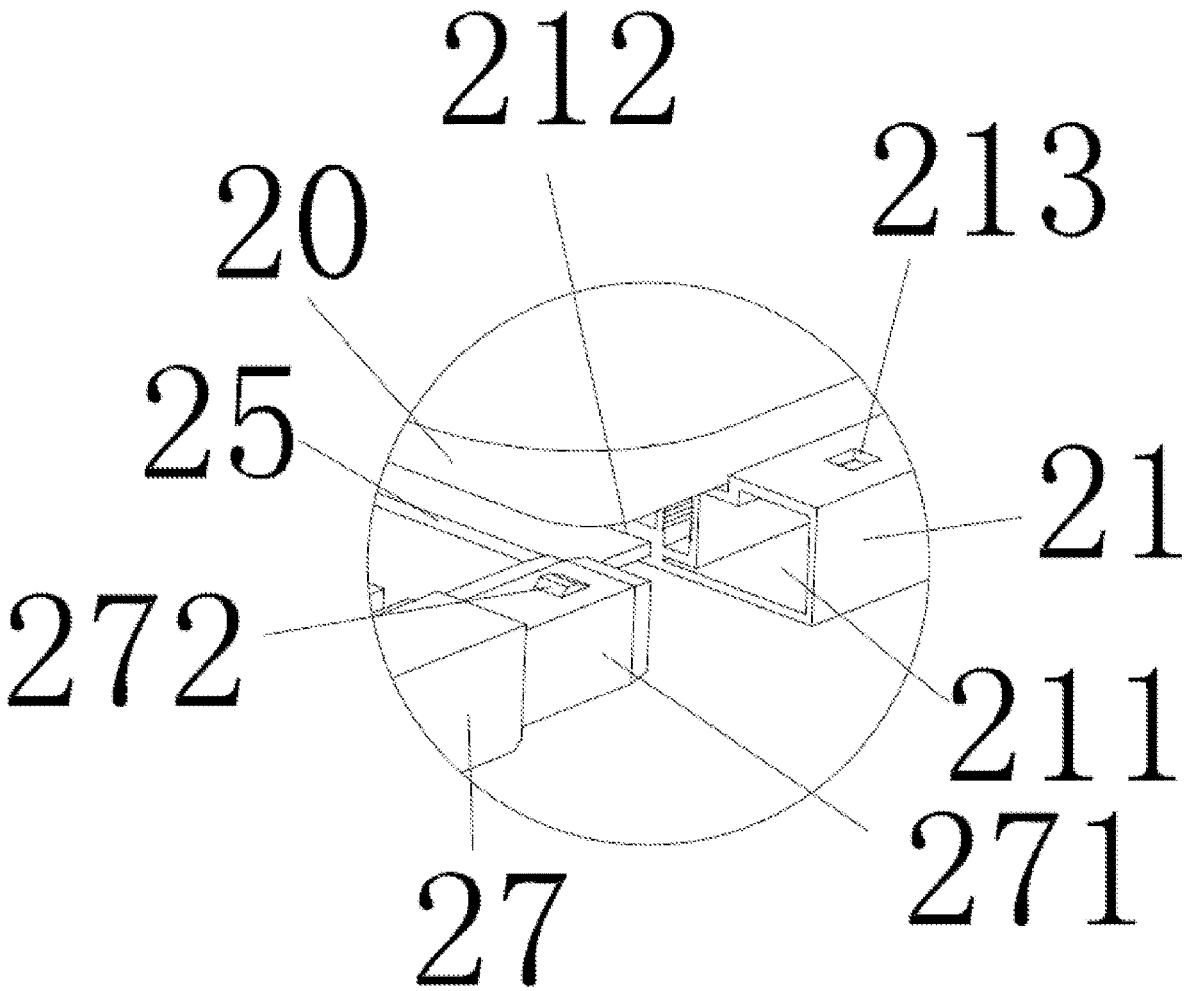
FIG. 9 is an enlarged view of Position G.
Figure 10:
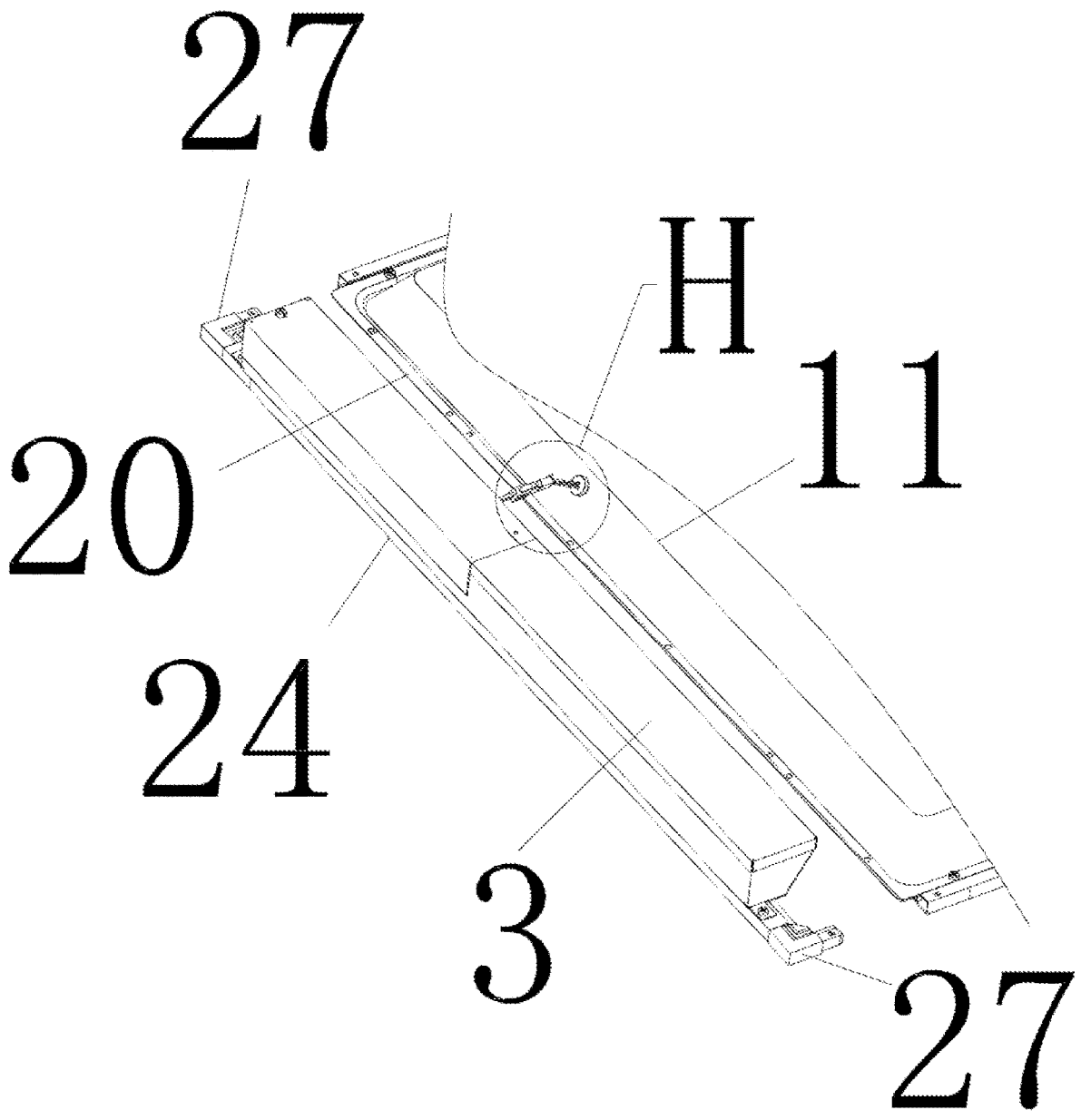
FIG. 10 is the structural schematic view (III) of the assembly of lighting fixtures.
Figure 11:
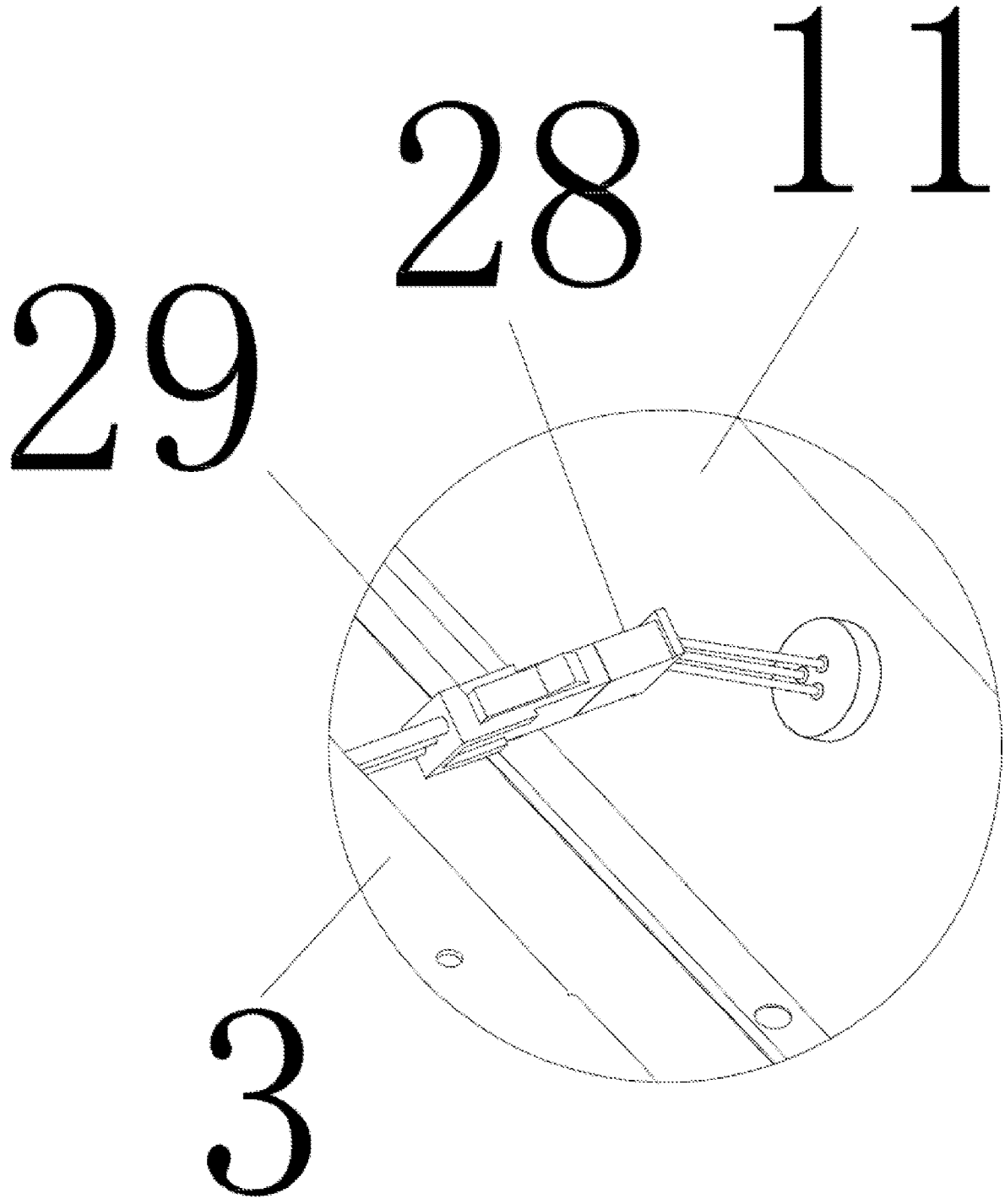
FIG. 11 is an enlarged view of Position H.
Figure 12:
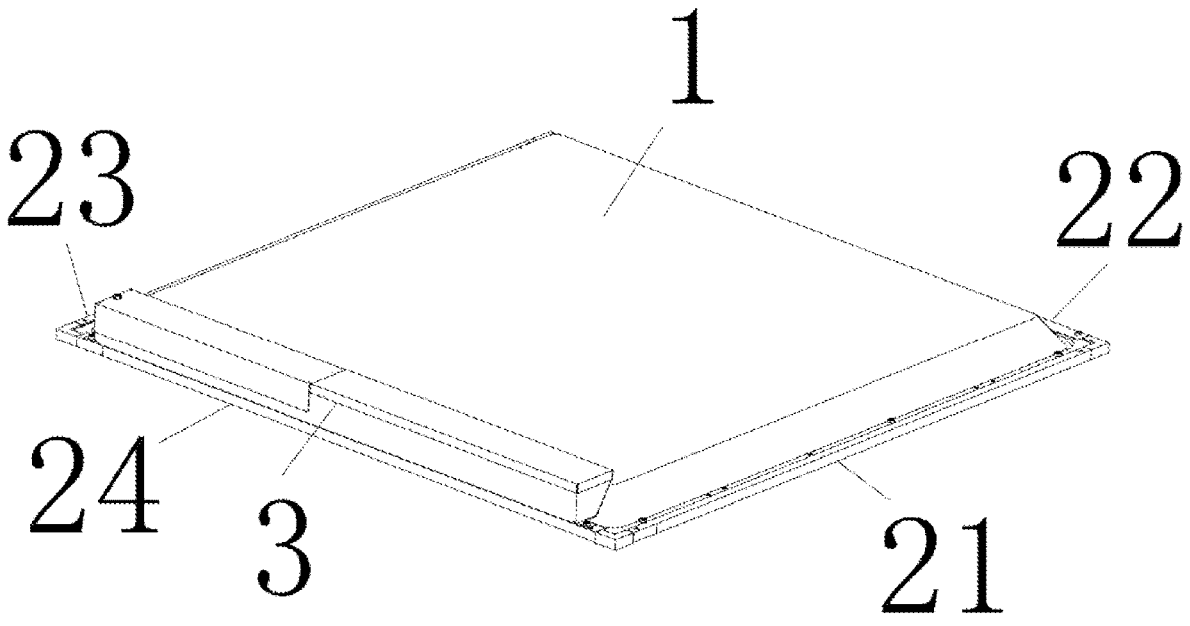
FIG. 12 is a structural schematic view of an assembled lighting fixture.
Figure 13:
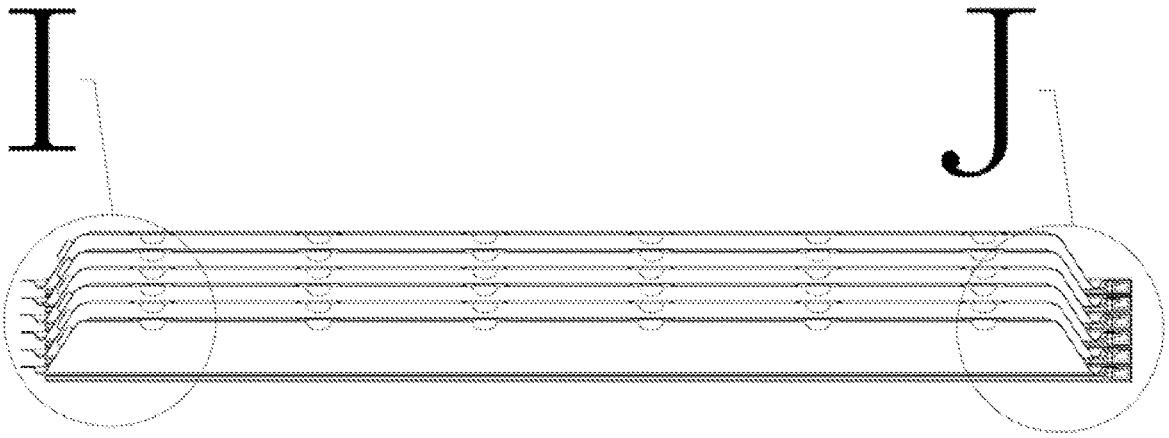
FIG. 13 is a structural schematic view (III) of six stacked lampshades.
Figure 14:
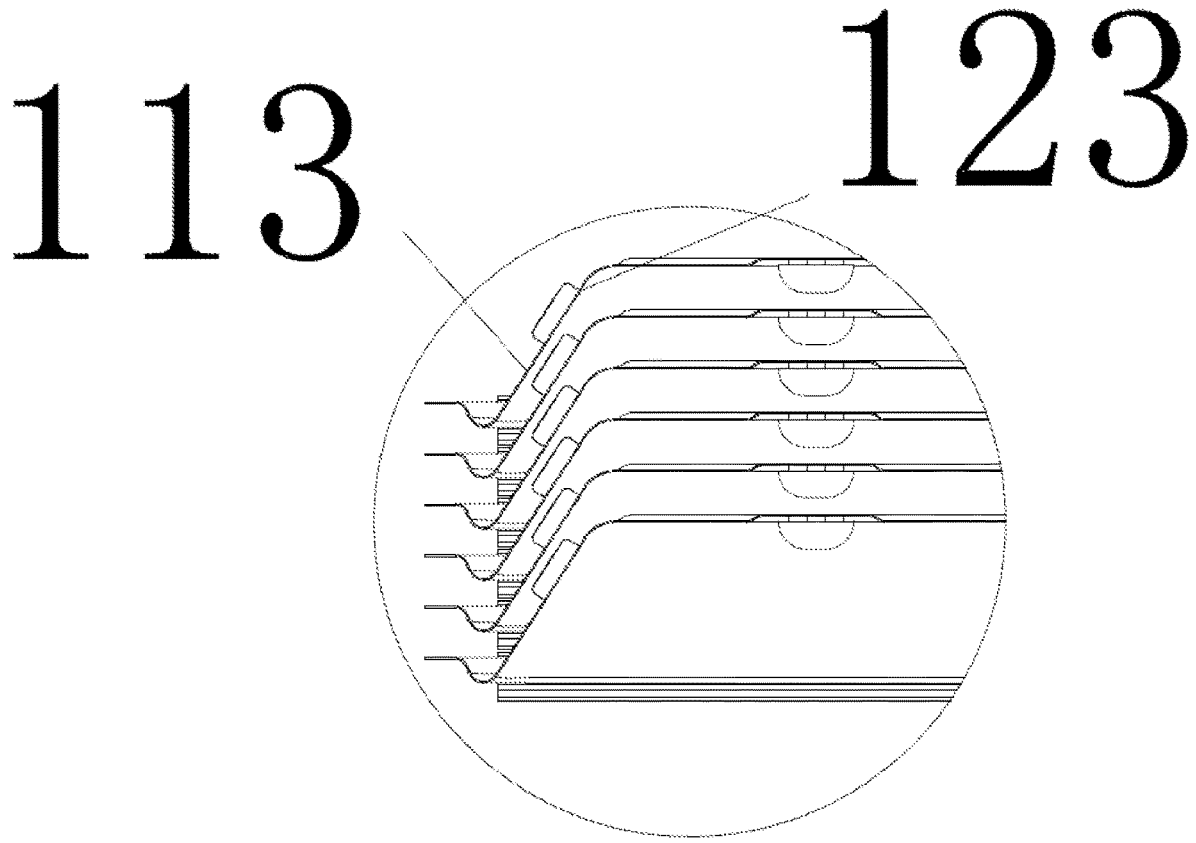
FIG. 14 is an enlarged view of Position I.
Figure 15:
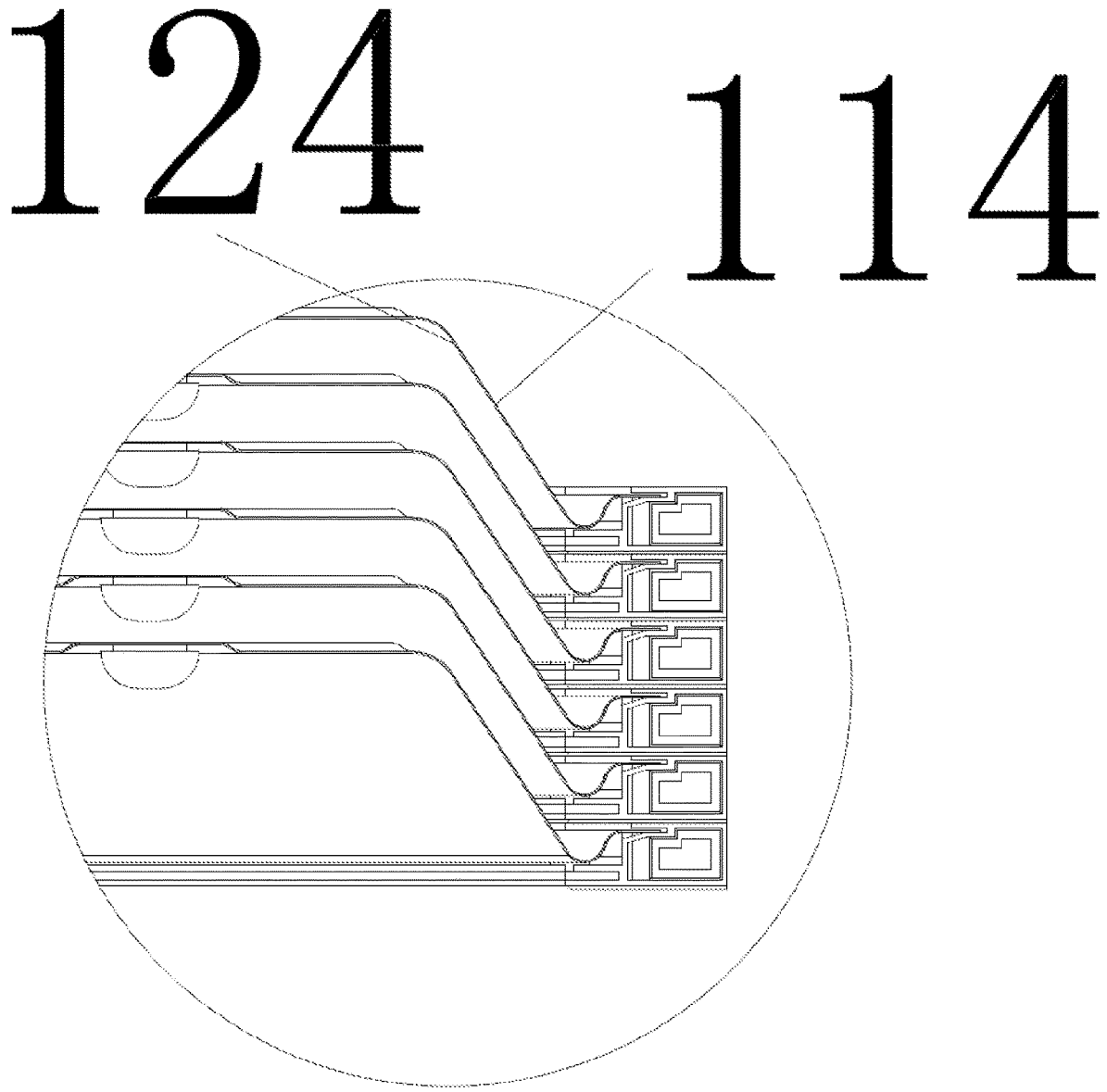
FIG. 15 is an enlarged view of Position J.

As illustrated in FIG. 1-FIG. 15, this embodiment describes a lighting fixture convenient to pack, which consists of a lampshade, wherein the lampshade 1 consists of a hood body 11, an inner cavity 12 arranged opposite to the hood body 11, and a frame 13 at the opening edge of the inner cavity 12; the frame is away from the inner cavity; the inner cavity 12 is used to accommodate the luminous source 10 of the lighting fixture; the hood body 11 consists of a horizontal outer wall surface 115 and multiple oblique outer wall surfaces formed at the edge of the horizontal outer wall surface 115, and each oblique outer wall surface and the horizontal outer wall surface 115 has an included angle of a; the inner cavity 12 consists of a horizontal inner wall surface 125 and multiple oblique inner wall surfaces 121 formed at the edge of the horizontal inner wall surface 125, and each oblique inner wall surface and the horizontal inner wall surface 125 has an included angle of b; the said multiple oblique outer wall surfaces are respectively the first oblique outer wall surface 111, the second oblique outer wall surface 112, the third oblique outer wall surface 113, and the fourth oblique outer wall surface 114, the first oblique outer wall surface 111 and the second oblique outer wall surface 112 are arranged opposite to each other, while the third oblique outer wall surface 113 and the fourth oblique outer wall surface 114 are arranged opposite to each other; the said multiple oblique inner wall surfaces are respectively the first oblique inner wall surface 121, the second oblique inner wall surface 122, the third oblique inner wall surface 123, and the fourth oblique inner wall surface 124, the first oblique inner wall surface 121 and the second oblique inner wall surface 122 are arranged opposite to each other, while the third oblique inner wall surface 123 and the fourth oblique inner wall surface 124 are arranged opposite to each other. The angle of inclination of wall surface and the frame away from the inner cavity are arranged to ensure that, upon the stacking, the hood body of one lampshade is inserted into the inner cavity of the other lampshade, and after the stacking, the hood body and the inner cavity wall do not have any contact. The hood body is a sheet metal part formed by one-piece stamping of a metal plate.

Preferably, the included angle a between the first oblique outer wall surface 111/the second oblique outer wall surface 112/the third oblique outer wall surface 113/the fourth oblique outer wall surface 114 and the horizontal outer wall surface 115 is 237°; the included angle b between the first oblique inner wall surface 121/the second oblique inner wall surface 122/the third oblique inner wall surface 123/the fourth oblique inner wall surface 124 and the horizontal inner wall surface 125 is 123°; the lampshade is stamped with a metal plate; the horizontal inner wall surface 125 of the inner cavity is fixed with a luminous source 10, and the luminous source 10 is a LED light bar.

Preferably, the frame 13 consists of the first edging 21, the second edging 22, and the third edging 23; the opening edge of the inner cavity 12 is arranged with four edge connecting pieces 20 that are connected end to end; the first edging 21, the second edging 22, and the third edging 23 are respectively fixed on any three edge connecting pieces 20; two ends of the first edging 21 are respectively connected with one end of the second edging 22 and one end of the third edging 23; and the inner walls of the first edging 21, the second edging 22, and the third edging 23 are arranged with the elongated slots 212 for the insertion of light-transmitting plate 25 sides of the lighting fixture. When the lighting fixture is assembled, the light-transmitting plate 25 of quadrangular structure is used, the three sides of the light-transmitting plate 25 are inserted into the first edging 21, the second edging 22, and the third edging 23 respectively; the fourth edging 24 of the frame is taken out, and the actuator 3 is fixed on the fourth edging 24. Two ends of the fourth edging 24 are respectively connected with the other end of the second edging 22 and the other end of the third edging 23 in a removable manner, and the inner wall of the fourth edging 24 is arranged with the elongated slots 212 for the insertion of light-transmitting plate 25 sides of the lighting fixture. The remaining side of the light-transmitting plate 25 is also inserted into the elongated slots 212 of the fourth edging 24. Finally, the fourth edging 24 is fixed with the remaining edge connecting piece 20 by bolts. The first edging 21, the second edging 22, and the third edging 23 are made of aluminum profile.

Preferably, the first connecting plug 28 is inserted on the oblique outer wall surface of the hood body 11, the second connecting plug 29 is arranged on the actuator 3, and the first connecting plug 28 and the second connecting plug 29 are connected. The structural arrangement makes it convenient for electric connection. Both the first connecting plug 28 and the second connecting plug 29 are equipped with conductive metal pieces, so the conductive metal piece of the first connecting plug 28 and the conductive metal piece of the second connecting plug 29 are connected.

Preferably, the frame 13 also has the joints 27 fixed on both ends of the fourth edging 24; each joint 27 has an inserting part 271 and a fastening part 272; the other end of the second edging 22 and the other end of the third edging 23 are respectively equipped with the inserting slots 211 that match the inserting parts 271; each inserting slot 211 has a fastening slot 213 that matches the fastening part 272; the inserting part 271 is inserted into the inserting slot 211, and the fastening part 272 is fastened into the fastening slot 213. The structural arrangement makes it convenient for the installation and disassembly of the fourth edging 24, thus improving the ease of use and facilitating the packaging of multiple lighting fixtures. The joints 27 are made of plastic materials.

In addition, this embodiment describes the packaging of multiple above-mentioned lighting fixtures. The packaging involves multiple above-mentioned lighting fixtures. The lampshades 1 of such lighting fixtures match each other and stack to form a stacked body. The light-transmitting plate 25 and the fourth edging 24 with the actuator are separated from the lampshade. Each lampshade 1 consists of a hood body 11, an inner cavity 12 arranged opposite to the hood body 11, and a frame 13 at the opening edge of the inner cavity 12; the hood body 11 of one lampshade 1 is placed in the inner cavity 12 of the other lampshade 1; for two adjacent lampshades 1, one lampshade 1 is placed on the other lampshade 1, the hood body 11 of one lampshade 1 is placed in the inner cavity 12 of the other lampshade 1, the frame 13 of one lampshade 1 fits the frame 13 of the other lampshade 1, the multiple oblique outer wall surfaces of one lampshade 1 have certain spacing with the multiple oblique inner wall surfaces of the other lampshade 1, and the horizontal outer wall surface 115 of one lampshade 1 has certain spacing with the horizontal inner wall surface 125 of the other lampshade 1. The frame 13 is used to hold up the hood body 11 to form the space between the outside wall of the hood body 11 of lampshade 1 and the inner wall of the inner cavity 12 of the other lampshade 1. The spacing is set to prevent the friction between the outer wall of the lampshade 1 and the inner wall of the lampshade 1 and avoid any scratches on the outer wall of the lampshade 1. In addition, during the stacking, the lampshade only has the first edging 21, the second edging 22, and the third edging 23, so that 2-6 lampshades can be stacked and packed when the remaining edge of the lampshade is not closed; after the stacking, the first edging 21 of one lampshade fits the first edging 21 of the other lampshade, the second edging 22 of one lampshade fits the second edging 22 of the other lampshade, the third edging 23 of one lampshade fits the third edging 23 of the other lampshade, and the remaining edge connecting piece 20 at the opening of the inner cavity 12 is reserved.

After the box body 200 is opened and a single lampshade is taken out separately, a light-transmitting plate 25 is taken out from the box body specially for packaging the light-transmitting plate 25, the fourth edging 24 with the actuator 3 is taken out from the box body specially for packaging the fourth edging 24, and the lighting fixture is assembled according to the assembly method of this Embodiment.

The present invention is not limited to the above-mentioned preferred embodiment. Anyone may get other products in various forms under the inspiration of the present invention. However, whatever changes are made in the shape or structure of the products, any products with the same or similar technical schemes to the present application will fall within the scope of protection of the present invention.

What is claimed is:

1. A lighting fixture convenient to pack, which is characterized in that it consists of a lampshade and a luminous source, wherein the lampshade consists of a hood body and a frame, the hood body has an inner cavity, the frame is arranged at the opening edge of the inner cavity of the hood body and it is away from the inner cavity of the hood body; the inner cavity is used to accommodate the luminous source of the lighting fixture; the hood body consists of a horizontal outer wall surface, a first oblique outer wall surface, a second oblique outer wall surface, a third oblique outer wall surface and a fourth oblique outer wall surface; the inner cavity of the hood body consists of a horizontal inner wall surface, a first oblique inner wall surface, a second oblique inner wall surface, a third oblique inner wall surface and a fourth oblique inner wall surface; and the first oblique outer wall surface, the second oblique outer wall surface, the third oblique outer wall surface and the fourth oblique outer wall surface are respectively formed at the edge of the horizontal outer wall surface of the hood body; the first oblique outer wall surface and the second oblique outer wall surface are arranged opposite to each other, while the third oblique outer wall surface and the fourth oblique outer wall surface are arranged opposite to each other; the first oblique outer wall surface, the second oblique outer wall surface, the third oblique outer wall surface, the fourth oblique outer wall surface and the horizontal outer wall surface has an included angle of a; and the first oblique inner wall surface, the second oblique inner wall surface, the third oblique inner wall surface and the fourth oblique inner wall surface are respectively formed at the edge of the horizontal inner wall surface; the first oblique inner wall surface, the second oblique inner wall surface, the third oblique inner wall surface, the fourth oblique inner wall surface and the horizontal inner wall surface of the hood body form a prismatic inner cavity; the first oblique inner wall surface and the second oblique inner wall surface are arranged opposite to each other, while the third oblique inner wall surface and the fourth oblique inner wall surface are arranged opposite to each other; the first oblique inner wall surface, the second oblique inner wall surface, the third oblique inner wall surface, the fourth oblique inner wall surface and the horizontal inner wall surface has an included angle of b; and the frame consists of a first edging, a second edging, and a third edging; the opening edge of the inner cavity of the hood body is arranged with four edge connecting pieces that are connected end to end; the first edging, the second edging, and the third edging are respectively fixed on any three edge connecting pieces; two ends of the first edging are respectively connected with one end of the second edging and one end of the third edging; and the inner walls of the first edging, the second edging, and the third edging are arranged with elongated slots for the insertion of light-transmitting plate sides of the lighting fixture.

2. A lighting fixture convenient to pack according to claim 1, which is characterized in that the frame also has the fourth edging, on which an actuator is fixed; two ends of the fourth edging are respectively connected with the other end of the second edging and the other end of the third edging in a removable manner, and the inner wall of the fourth edging is arranged with the elongated slots for the insertion of light-transmitting plate sides of the lighting fixture.

3. A lighting fixture convenient to pack according to claim 2, which is characterized in that the lighting fixture further consists of a first connecting plug and a second connecting plug, the first connecting plug is inserted on the oblique outer wall surface of the hood body, the second connecting plug is arranged on the actuator, and the first connecting plug and the second connecting plug are connected.

4. A lighting fixture convenient to pack according to claim 2, which is characterized in that the fourth edging is connected to the remaining edge connecting piece.

5. A lighting fixture convenient to pack according to claim 2, which is characterized in that the frame further consists of two joints, and each joint is respectively fixed on both ends of the fourth edging; each joint has an inserting part and a fastening part; the other end of the second edging and the other end of the third edging are respectively equipped with the inserting slots that match the inserting parts; each inserting slot has a fastening slot that matches the fastening part; the inserting part is inserted into the inserting slot, and the fastening part is fastened into the fastening slot.

6. A lighting fixture convenient to pack according to claim 2, which is characterized in that the included angle a is 237° and the included angle b is 123°.

7. A lighting fixture convenient to pack according to claim 6, which is characterized in that the hood body and the frame of the lampshade are formed by stamping of a metal plate.

* * * * *